United States Patent [19]

Llorens et al.

[11] Patent Number: 4,859,082

[45] Date of Patent: Aug. 22, 1989

[54] CONTINUOUS BAG STRIP

[75] Inventors: Rafael G. Llorens; Juan V. Sole, both of Barcelona, Spain

[73] Assignee: Esselte Meto, Barcelona, Spain

[21] Appl. No.: 169,167

[22] Filed: Mar. 10, 1988

Related U.S. Application Data

[63] Continuation of Ser. No. 766,357, Aug. 16, 1985.

[30] Foreign Application Priority Data

Aug. 29, 1984 [ES] Spain ..... 281395

[51] Int. Cl.[4] ..... B65D 33/06

[52] U.S. Cl. ..... 383/8; 383/37; 383/77

[58] Field of Search ..... 383/8, 37, 77; 206/554

[56] References Cited

U.S. PATENT DOCUMENTS 3,966,524 6/1976 Lehmacher ..... 383/8
3,990,625 11/1976 Jelling et al. ..... 206/390
4,554,192 11/1985 Benoit ..... 383/8

FOREIGN PATENT DOCUMENTS 79465 1/1982 Australia ..... 383/8
273796 8/1969 Austria ..... 383/8
159939 10/1985 European Pat. Off. ..... 383/37

*Primary Examiner*—Stephen P. Garbe
*Attorney, Agent, or Firm*—Gerald J. Ferguson, Jr.

[57] ABSTRACT

A continuous bag strip separable into a plurality of bags is formed of a flat, continuous tubular strip of flexible plastic material having opposite sides and longitudinal edges each of which has an inward longitudinal fold made along a fold line, the strip having a plurality of longitudinally spaced apart transverse weld lines extending from one longitudinal edge of the strip to the other and a plurality of transverse perforation lines each located close to a respective weld line and extending from one longitudinal edge of the strip to the other such that the strip may be separated into bags each having a bottom formed by one of the weld lines, each side of the strip having a plurality of longitudinally elongated die-cut openings at the location of each of the fold lines, each opening having two longitudinal edges and two traverse edges; one transverse edge of each opening lying on a perforation line or between that perforation line and the corresponding adjacent weld line and the other transverse edge of each opening being semicircular in shape.

6 Claims, 2 Drawing Sheets

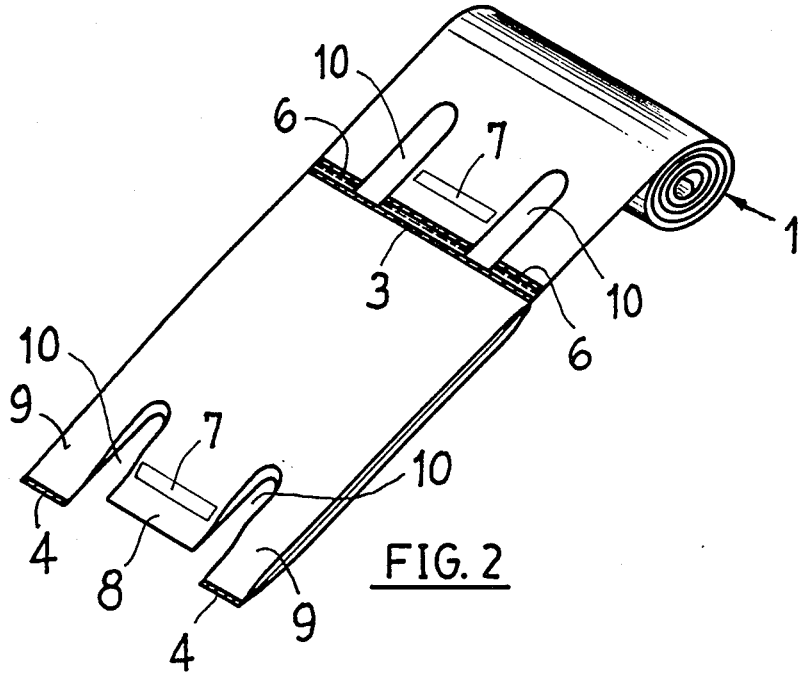
FIG. 2
FIG. 3
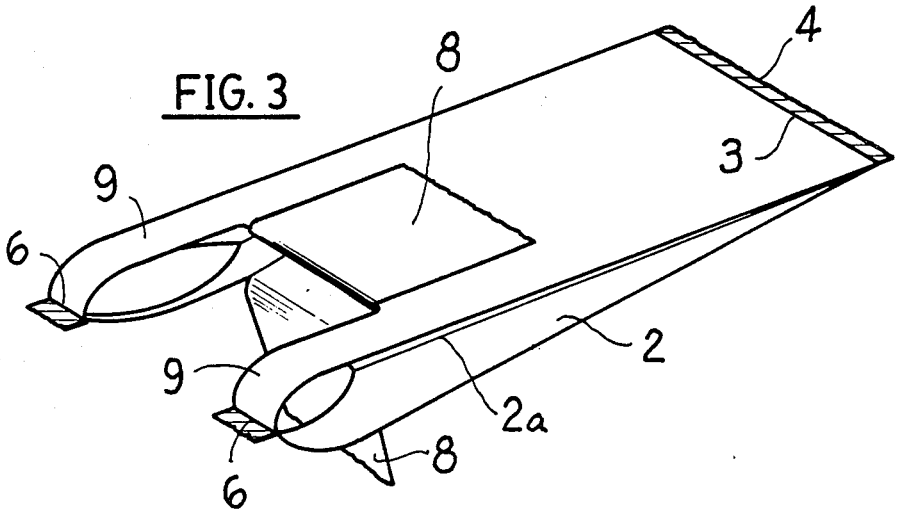

CONTINUOUS BAG STRIP

This application is a continuation of Ser. No. 766,357, filed 8/16/85.

The present invention relates to a continuous bag strip, of the type of those used in bag dispensing machines commonly called the "vest" type, and which present an ample recess between the two side handles. These bags are initially joined together, forming the strip in which perforation lines which affect the top part of the handles are made. The purpose of this perforation is to be able to separate each bag from the following bag. This is carried out by applying action with a pulling means on the actual dispensing machine, although it usually happens, due to the mentioned traction, that the bags get creased and on occasions even break at the narrow weak parts where the handles are joined.

This problem was to be solved by making a continuous bag strip in which the big opening corresponding to the recess between the handles was suppressed, at the same time as the perforation lines were placed to occupy the complete width of the strip, with two longitudinal cuts having been envisaged. These cuts affect each side of the continuous strip for each bag, with the aim of determining the recess and the formation of the handles once each bag is separated from the following one.

However, in this construction, an important drawback appears: with the cutting operation, to give rise to the cuts which will determine the opening corresponding to the recess and produce the separation between the bags, the formation of small, stretched pieces left over from the plastic material which has been cut takes place. These left overs generally stay inside each bag, and this produces a nuisance and unpleasant effect for the person using the bag.

In the construction which is the object of the invention, not only has the mentioned obstacle been eliminated, but also a saving in plastic material has been achieved, on obtaining a larger piece left over, which can be recovered, in the cutting thanks to the die cutting of the material which gives rise to an opening which substitutes the simple cut in the first construction, with also the obtaining of an aesthetic effect superior to that obtained to present in the vest type bag.

Essentially, the continuous bag strip, which is particularly applicable for use in the bag dispensing machines, of the type of those consisting of a flat, continuous, conventional tubular strip of a flexible plastic material, fitted on each of the longitudinal edges with an inward longitudinal fold and which has several groups of equidistantly separated transversal lines at a distance equal to the length of a bag, and consisting of a welding line which makes up the bottom of each bag and a perforation line near the welding line, so as to be able to separate each bag from the others, is characterized by the fact that on each inward fold line for each longitudinal fold, an oblong, longitudinal opening is made by die cutting. This opening is parallel to the longitudinal edge of the strip, so the longitudinal edges of each oblong opening are in such a way that there is one on each side of the mentioned inward fold line, and one of the transversal edges of the oblong opening is on the perforation line or between this line and the corresponding adjacent welding line which makes up the bottom of the bag, while the other transversal edge is an appreciably semicircumferential shape.

To facilitate the explanation, reference may be had as a non-limiting example of the scope of this invention.

FIG. 2 represents a perspective view of an unrolled bag of the strip and

Figure 1:
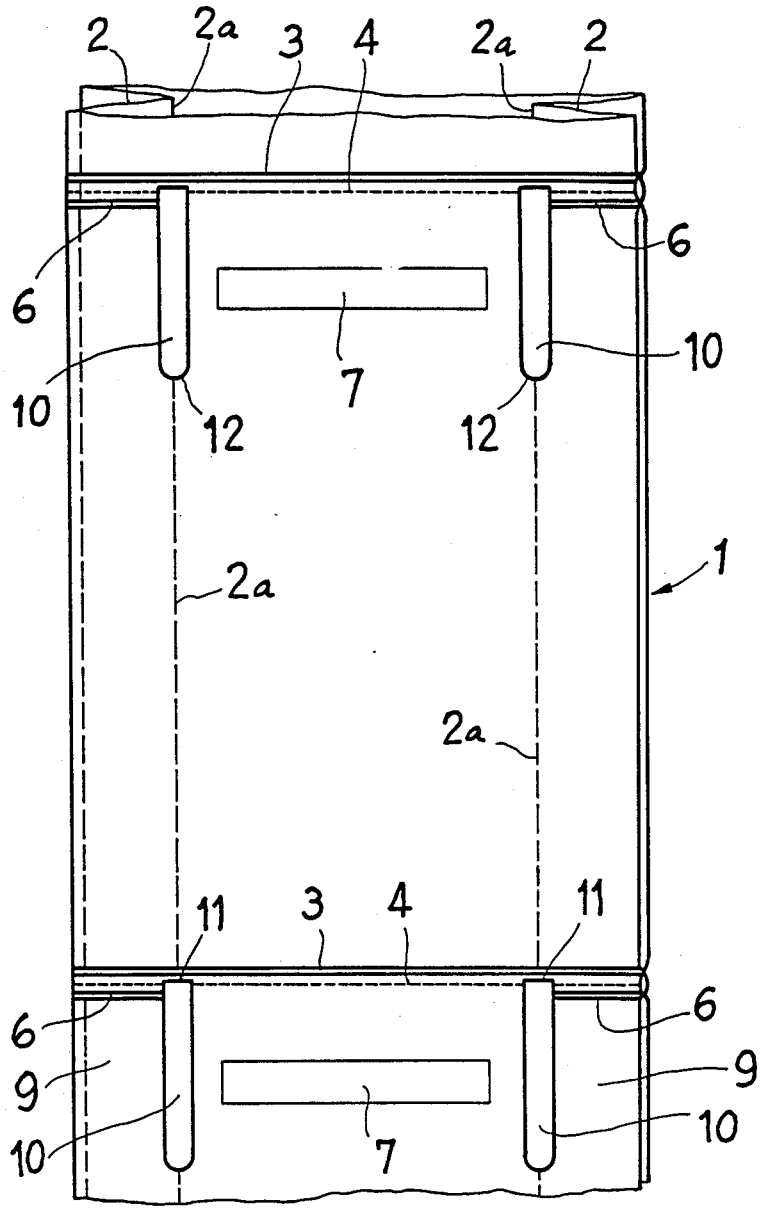
FIG. 1 illustrates a top view of a preferred bag strip.

FIG. 3 also shows a perspective view of a bag which has been separated from the strip.

FIG. 1 illustrates a flat, continuous, conventional tubular strip, 1, of a flexible plastic material having opposite sides and longitudinal edges formed with inward folds. Strip 1 has transversal welding lines 3 which make up the respective bottoms of the bags, and perforation lines 4, which are also transversal and near the weld lines 3, for separating one bag from the following one.

In each side of the strip, along each inward fold line 2*a* of each longitudinal fold, an oblong, longitudinal opening 10 is die cut parallel to the longitudinal edge of the strip 1. One of the transversal edges 11 of each opening 10 is on the perforation line 4 or between this line and the corresponding adjacent welding line 3 which makes up the bottom of the bag. The other transversal edge 12 is an appreciably semicircumferential shape.

For each bag, two transversal welding lines 6 have been envisaged, and they are close to the perforation line 4 and go from each opening 10 to the corresponding side of the strip, joining both sides of the same with the respective fold 2.

The dispensing machines which supply individual bags from a continuous strip 1 are usually fitted with a device which detects the passage of each bag to be supplied. The components of this device are situated on both sides of the continuous strip 1, carrying out the detection through the recess which the vest type bags have. As the bag which is the object of this invention precisely lacks the recess, so as not to weaken the body of the bag and to resist without getting creased or deformed, the traction stresses produced by the mechanism of the machine that will separate it from the rest of strip 1, each side of the bag has openings or optically detectable indicia or signs 7 of the right size to allow the acting of the bag passage detecting device.

As an effect of the traction applied by the traction means, such as rollers or others included in the dispensing machine, each bag is separated from the next one when strip 1 is torn by the perforation lines 4, owing to which, from these lines and the opening lines 10, two lobes 8 are formed in each bag and they lie on the outsides of the bag itself. The welding lines 6 join the sides of strip 1 with the fold 2, so that the handles 9 are formed, as shown in FIGS. 2 and 3.

Everything that does not alter, change or modify the essence of the continuous bag strip described may remain subject to variation in details.

We claim:

1. A continuous bag strip separable into a plurality of bags comprising a flat, continuous tubular strip of flexible plastic material having opposite sides and longitudinal edges each of which edges has an inward longitudinal fold made along a fold line, said strip having a plurality of longitudinally spaced apart transverse weld lines extending from one longitudinal edge of said strip to the other and a plurality of transverse perforation lines each located close to a respective weld line and extending from one longitudinal edge of said strip to the other such that said strip may be separated at said perforation lines into bags each having a bottom formed by one of said weld lines, each side of said strip having a plurality of longitudinally elongated die-cut openings at the location of each of said fold lines, each opening having two longitudinal edges and two transverse edges; one transverse edge of each opening lying on a perforation line or between that perforation line and the corresponding adjacent weld line and the other transverse edge of each opening being semi-circular in shape where each said bag has a pair of said openings extending in substantially parallel relationship from the perforation line associated with each bag so that each bag has a pair of lobes respectively in the sides thereof, each lobe continuously extending from the perforation line to said semi-circular transverse edges of the openings and being unattached to one another; and a plurality of second transverse weld lines each of which extends from one longitudinal edge of said strip to an adjacent longitudinal edge of one of said openings.

2. A bag strip as in claim 1 including, in at least one side of said strip, a plurality of holes adapted to activate a device which detects the passage of each bag in a bag dispensing machine, each of said holes being located between a respective pair of said openings.

3. A bag strip as in claim 1 including, in at least one side of said strip, a plurality of optically detectable indicia adapted for activating a device which detects the passage of each hole in a bag in a bag dispensing machine, each indicia being located between a respective pair of said openings.

4. A continuous bag strip as in claim 1 where each said bag has at least one optically detectable indicia disposed on at least one of its lobes, said indicia being adapted to detect the passage of the bag in a bag dispensing machine.

5. A continuous bag strip as in claim 1 where each said bag has at least one hole disposed in at least one of its lobes, said hole being adapted to detect the passage of the bag in a bag dispensing machine.

6. A continuous bag strip as in claim 1 where each of said plurality of second transverse weld lines extends only from one longitudinal edge of said strip to an adjacent longitudinal edge of one of said openings.

* * * * *